US008020221B2

(12) United States Patent
Borochov et al.

(10) Patent No.: US 8,020,221 B2
(45) Date of Patent: Sep. 20, 2011

(54) HANDS-FREE TOILET SEAT LIFTING DEVICE

(76) Inventors: Erez Borochov, Moshav Neve Yamin (IL); Meir Gitelis, Moshav Bnei Atarot (IL)

( * ) Notice: Subject to any disclaimer, the term of this patent is extended or adjusted under 35 U.S.C. 154(b) by 312 days.

(21) Appl. No.: 12/408,701

(22) Filed: Mar. 22, 2009

(65) Prior Publication Data

US 2010/0005580 A1 Jan. 14, 2010

Related U.S. Application Data

(60) Provisional application No. 61/080,280, filed on Jul. 14, 2008.

(51) Int. Cl.
*A47K 13/10* (2006.01)

(52) U.S. Cl. ..... 4/246.2; 4/246.3; 4/313; 4/250; 4/408; 220/262

(58) Field of Classification Search ..... 4/248–250, 4/302, 304, 305, DIG. 3, 246.1, 246.2, 246.3, 4/408; 220/262–264
See application file for complete search history.

(56) References Cited

U.S. PATENT DOCUMENTS

| | | | | |
|---|---|---|---|---|
| 4,103,371 | A * | 8/1978 | Wilson | 4/246.2 |
| 5,014,367 | A * | 5/1991 | Gamblin | 4/246.2 |
| 5,029,347 | A * | 7/1991 | Lin | 4/246.2 |
| 5,103,506 | A * | 4/1992 | Munford et al. | 4/246.4 |
| 5,327,589 | A * | 7/1994 | Rice | 4/246.2 |
| 5,448,782 | A * | 9/1995 | Ratajac | 4/246.5 |
| 5,488,744 | A * | 2/1996 | Paananen | 4/246.2 |
| 5,594,958 | A * | 1/1997 | Nguyen | 4/246.5 |
| 6,643,866 | B1 * | 11/2003 | Stewart | 4/667 |
| 6,907,621 | B2 * | 6/2005 | Stemen | 4/246.1 |
| 2007/0044216 | A1 * | 3/2007 | Cosby | 4/246.1 |
| 2007/0056084 | A1 * | 3/2007 | Watt et al. | 4/246.1 |
| 2007/0250995 | A1 * | 11/2007 | White | 4/234 |

FOREIGN PATENT DOCUMENTS

| | | |
|---|---|---|
| FR | 2801488 | 11/1999 |
| JP | 11056682 | 3/1999 |

* cited by examiner

*Primary Examiner* — Brian Glessner
*Assistant Examiner* — Beth Stephan
(74) *Attorney, Agent, or Firm* — Haim Factor

(57) ABSTRACT

In one aspect, the present invention is directed to a toilet seat lifting device (10), comprising a pneumatic system employing a piston (48) connected to the toilet seat (6), the system being adapted to lift the toilet seat (6) by applying mechanical force on the piston (48) in the corresponding direction (upwards, in the example herein), and to gradually lowering the toilet seat by gradually releasing air from the pneumatic system. The device may further comprise a valve (56), for causing a fall in air pressure in the pneumatic system, thereby causing an accelerated lowering of the toilet seat. The device may further comprise: a sensor, for sensing lowering of toilet seat (6); and a mechanism for activating flushing the toilet bowl upon detecting by the sensor that the seat has been lowered, such as a handle of a tap providing water to the flush tank (8) thereof.

6 Claims, 6 Drawing Sheets

HANDS-FREE TOILET SEAT LIFTING DEVICE

The present invention claims priority from U.S. 61/080,280 filed on Jul. 14, 2008, and incorporated herein by reference.

FIELD OF THE INVENTION

The present invention relates to the field of toilet seats. More particularly, the invention relates to a toilet seat lifting device that allows a user to lift and lower the toilet seat without the need of manually touching the seat or flush handle, adapted to the special needs of men, but also suitable for women.

BACKGROUND OF THE INVENTION

The majority of men forget to lift the toilet seat, and as such, they urinate on the seat when the seat is in its horizontal state. The urination on the seat causes its contamination.

In order to lift and lower a toilet seat, the user thereof has to contact the seat physically, which many dislike and as such avoid touching toilet seats, especially in public toilet facilities such as train stations. Furthermore, men must raise a toilet seat to urinate. However, as they forget to lower the seat afterwards, preferring minimal contact with the seat, this task is left to the next female user.

It is an object of the present invention to provide a hands-free device for lifting and lowering a toilet seat.

It is a further object of the invention to provide a hands-free device for lifting and lowering a toilet seat, which is oriented for male use.

It is a still further object of the invention to provide a hands-free device for lifting and lowering a toilet seat, which also automatically flushes the toilet after use.

Other objects and advantages of the invention will become apparent as the description proceeds.

SUMMARY OF THE INVENTION

In one aspect, the present invention is directed to a toilet seat lifting device (10), comprising a pneumatic system employing a piston (48) connected to the toilet seat (6), the system being adapted to lift the seat (6) by applying mechanical force on the piston (48) in the corresponding direction (upwards in the example herein), and to gradually lower the toilet seat by gradually releasing it from the pneumatic system.

According to one embodiment of the invention, the pneumatic system comprises a substantially-vertical cylinder (18) corresponding to the piston (48), and a seal therebetween (82), wherein a space (80) enclosed in said cylinder beyond said piston is sealed except of a bore (62) for gradually releasing the enclosed air.

According to one embodiment of the invention, the act of applying mechanical force is carried out by applying force by a user on a lever (54) connected to the piston (48).

Preferably, the act of gradually releasing air from the pneumatic system is carried out via a bore (62) in the pneumatic system.

The device may further comprise a mechanism (such as a spring 44) for applying force to the piston (48) for lowering the toilet seat.

The device may further comprise a valve (56), for causing a fall in the air pressure of the pneumatic system, thereby causing an accelerated lowering of the toilet seat.

According to one embodiment of the invention, a bi-directional pedal (14) is attached to the lever (54), thereby allowing a user to move the pedal upwards, in order to release the valve (56).

The device may further comprise:

- a sensor (switch 24, jag 34, and a circuitry in module 22), for sensing lowering of toilet seat (6); and
- a mechanism for activating flushing the toilet bowl upon detecting by the sensor that the seat has been lowered, such as a handle of a tap providing water to the flush tank (8) thereof.

According to one embodiment of the invention, the pneumatic system comprises:

- a lever (54), to be operated by a user's foot;
- a substantially vertical rod (36), the lower side of the rod being connected to the lever (54), and the upper side of the rod being connected to the toilet seat (6);
- a piston (48), attached to the rod between the ends of the rod;
- a cylinder (18) corresponding to the piston (48), the rod being disposed inside the cylinder;
- a bore (62) in the cylinder in a location under the piston;
- a first valve (20) for allowing only entrance of air into the cylinder, the valve being disposed in the cylinder under the piston;
- wherein the space above the piston is unsealed, and the space below the cylinder is sealed except of the bore and the valve, the bore thereby determining the rate of air exiting the sealed space, resulting with determining the rate of automatic lowering of the toilet seat.

According to one embodiment of the invention, the device further comprises a second valve (56), for causing a fall in air pressure in the pneumatic system, thereby causing an accelerated lowering of the toilet seat.

The device may further comprise:

- a sensor (switch 24 and jag 34), for sensing toilet seat lowering; and
- a mechanism for activating flushing the toilet bowl upon detecting by the sensor that the seat being lowered.

In another aspect, the present invention is directed to a pneumatic system comprising:

- a lever (54), to be operated by a user's foot;
- a substantially vertical rod (36), the lower side of the rod being connected to the lever (54), and the upper side of the rod being connected to an object to be lifted and lowered, such as the toilet seat (6);
- a piston (48), attached to the rod between the ends of the rod;
- a cylinder (18) corresponding to the piston (48), the rod being disposed inside the cylinder;
- a bore (62) in the cylinder in a location under the piston;
- a first valve (20) for allowing only entrance of air into the cylinder, the valve being disposed in the cylinder under the piston;
- wherein the space above the piston is unsealed, and the space below the cylinder is sealed except of the bore and the valve, the bore thereby determining the rate of air exiting the sealed space, resulting with determining the rate of automatic lowering of the object.

According to one embodiment of the invention, the pneumatic system further comprises a second valve (56), for causing a fall in air pressure in the pneumatic system, thereby causing an accelerated lowering of the object.

The toilet seat lifting device can be installed in public toilet facilities as well as in domestic toilet facilities.

The forgoing embodiments of the invention have been described and illustrated in conjunction with systems and methods thereof, which are meant to be merely illustrative, and not limiting.

BRIEF DESCRIPTION OF THE DRAWINGS

Embodiments and features of the present invention are described herein in conjunction with the following drawings.

Each of FIGS. 1 and 2 schematically illustrates a toilet seat, in which a lifting device has been installed, according to one embodiment of the invention.

It should be understood that the drawings are not necessarily drawn to scale.

DETAILED DESCRIPTION OF THE INVENTION

The present invention will be understood from the following detailed description of various embodiments, which are meant to be descriptive and not limiting. For the sake of brevity, some well-known methods, systems, procedures, components, circuits, and so on, have not been described in detail.

Figure 1:
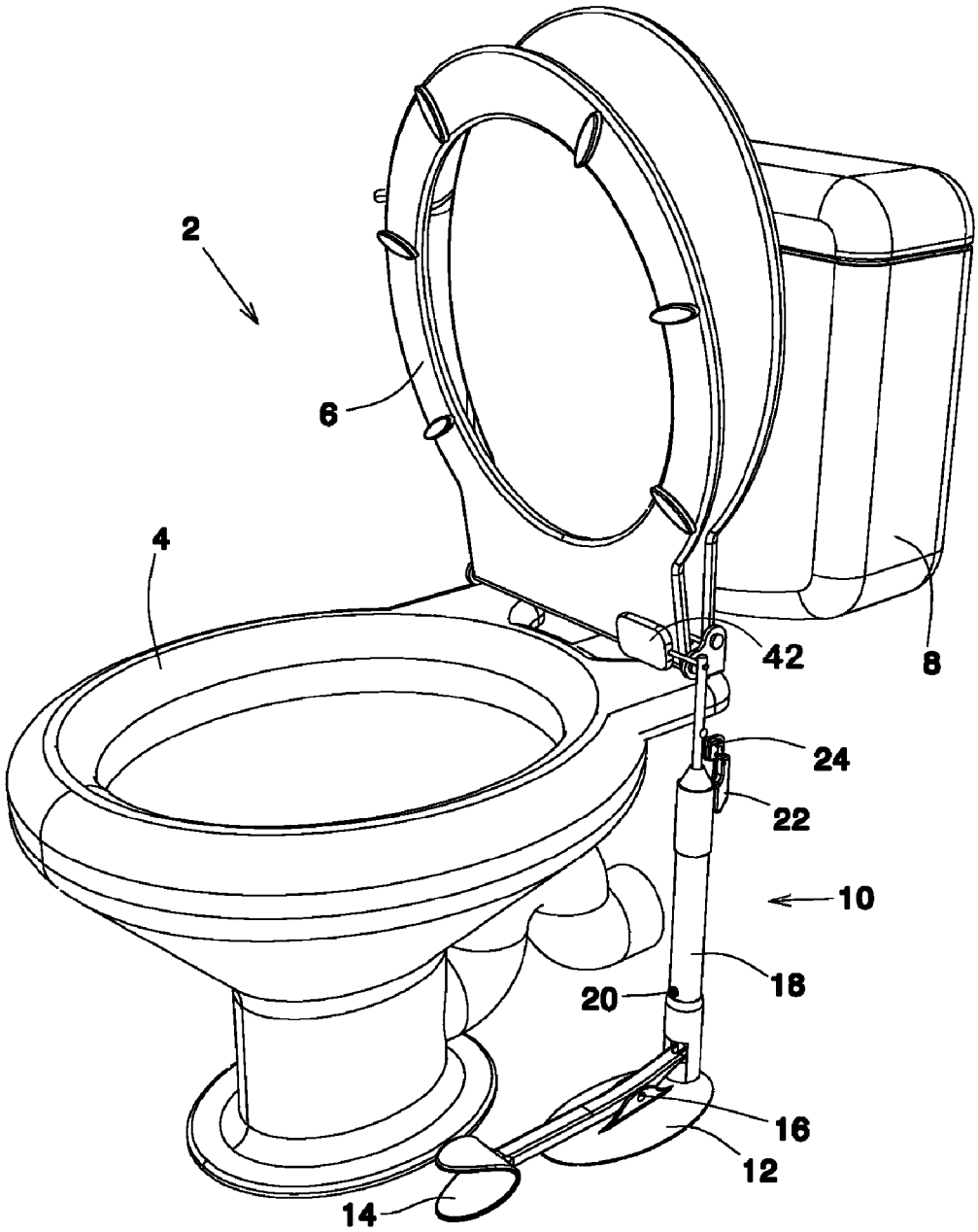
Figure 2:
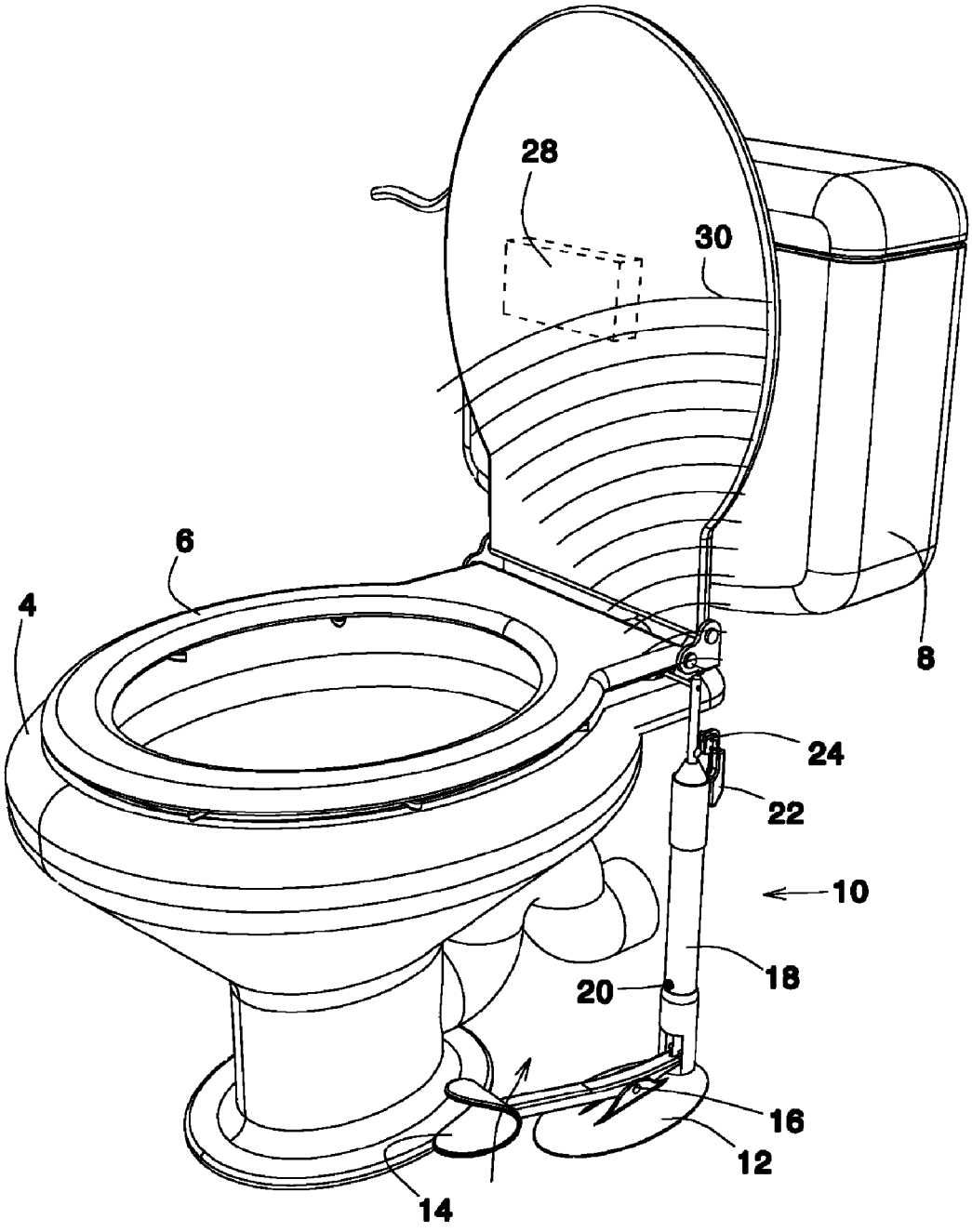

Each of FIGS. 1 and 2 schematically illustrates a toilet seat 6, in which a lifting device 10 has been installed, according to one embodiment of the invention. In FIG. 1 the toilet seat is lifted, and in FIG. 2, lowered.

In the example herein, pedal 14 is bi-directional, i.e., is adapted to allow a user to press it back and forth, or as in the present case, up and down. According to the examples illustrated herein, the bi-directionality is achieved by a crescent form of the pedal, which allows inserting a foot between the crescent edges.

The lifting device, marked herein by reference numeral 10, operates as follows: upon pressing bi-directional pedal 14 down, toilet seat 6 is lifted, thereby enabling a male user to urinate. Upon leaving the pedal, the toilet seat lowers gradually (i.e., "slowly"), thereby leaving the user enough time to complete urination. In the event the user wants to lower the seat faster, he lifts up pedal 14.

Figure 3:
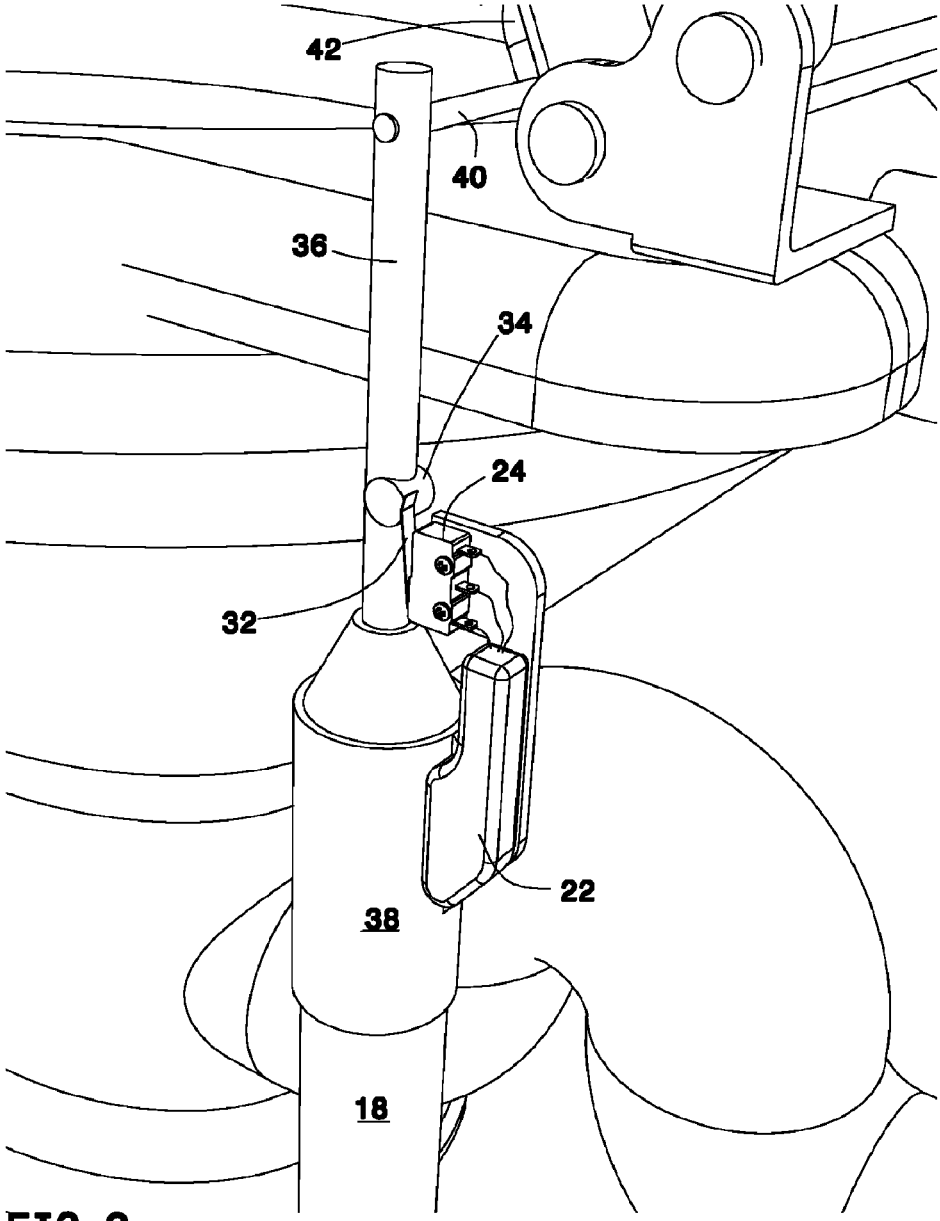
FIG. 3 schematically illustrates a mechanism for activating flushing as the toilet-seat lowers, according to one embodiment of the invention.

According to a further embodiment of the invention, detailed in FIG. 3, as the seat lowers, at a certain point the operation of flushing the toilet is automatically activated. Thus, the user need not touch either the seat or flush button of the toilet, thereby providing higher hygienic conditions in comparison to the prior art.

Figure 4:
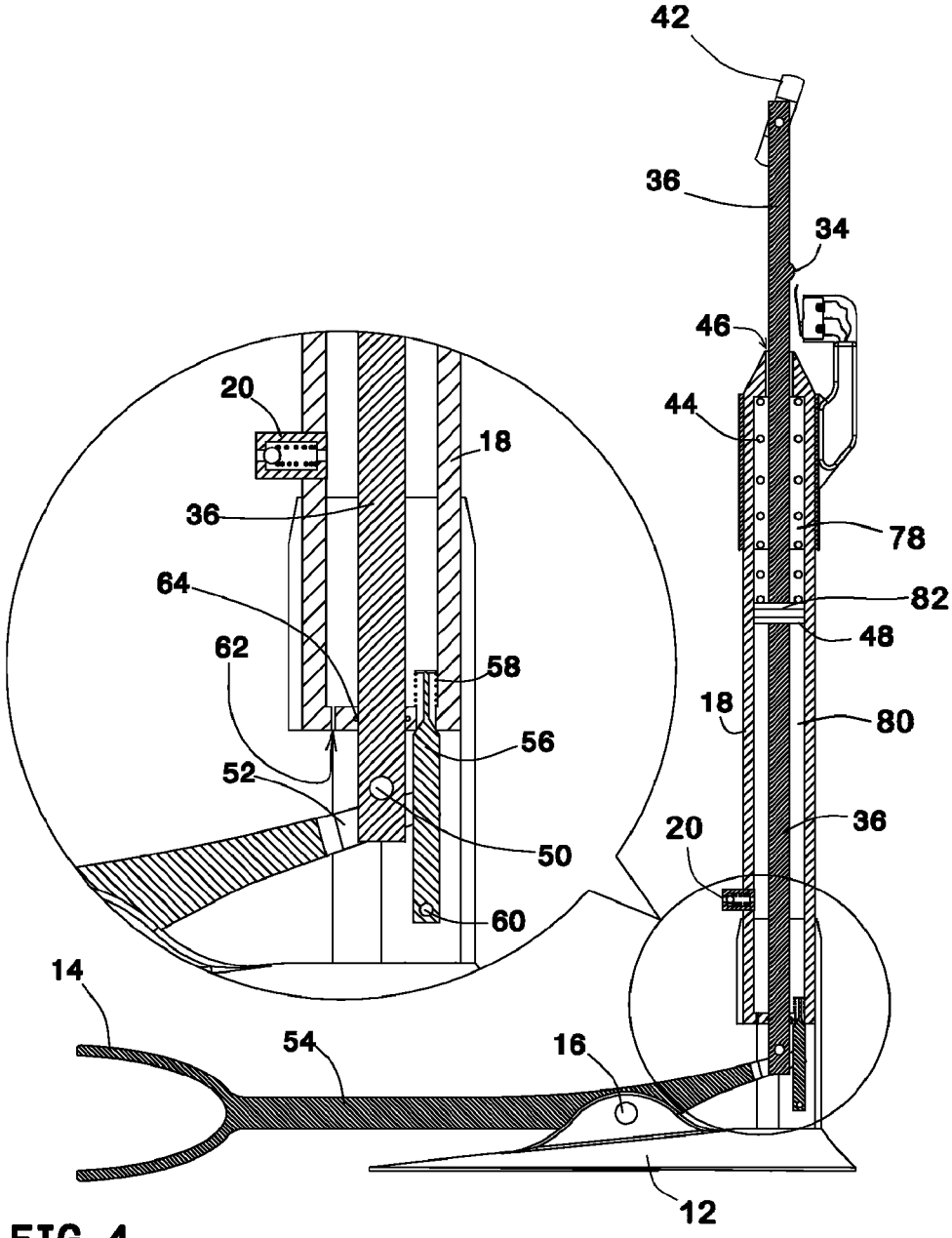
FIG. 4 is a sectional view schematically illustrating the operation mechanism of the lifting device, according to one embodiment of the invention.

FIG. 4 is a sectional view schematically illustrating the operation mechanism of the lifting device, according to one embodiment of the invention. FIG. 4 is a snapshot that illustrates the mechanism in the state wherein the seat is lifted.

Piston 48 is attached to rod 36, and disposed inside cylinder 18. A seal 82, such as rings, seals the space between the cylinder and piston. On the upper side of the piston a spring 44 is installed, which pushes the piston downwards.

Pedal 14 is a part of lever 54, which rotates around hinge 16. Upon pushing pedal 14 down, lever 54 pushes up pin 50, thereby lifting rod 36. Rod 36 is attached to hinge 40, which is attached to toilet seat 6 by tab 42, thereby lifting the toilet seat.

The piston divides the space inside cylinder 18 into two parts: upper space (marked herein by reference numeral 78), and lower space (marked herein by reference numeral 80). When rod 36 shifts up, the air enclosed in upper space 78 is pushed out through gap 46, while new air enters into lower space 80 through unidirectional valve 20. When rod 36 shifts down, air enters into the upper space through gap 46, while the air inside lower space 80 is pushed out through bore 62.

Spring 44 pushes piston 48 downwards. Thus, when leaving the pressed pedal 14, the pressure of spring 44 on piston 48 pushes out the air from lower space 80 through bore 62. Thus, bore 62 must be designed to be narrow enough to result in slow penetration of the air from lower space 80. The slow motion of the piston downwards results in the correspondingly slow motion of lowering seat 6, and the bore must be designed such that a male user will have adequate time to complete urination.

Figure 5:
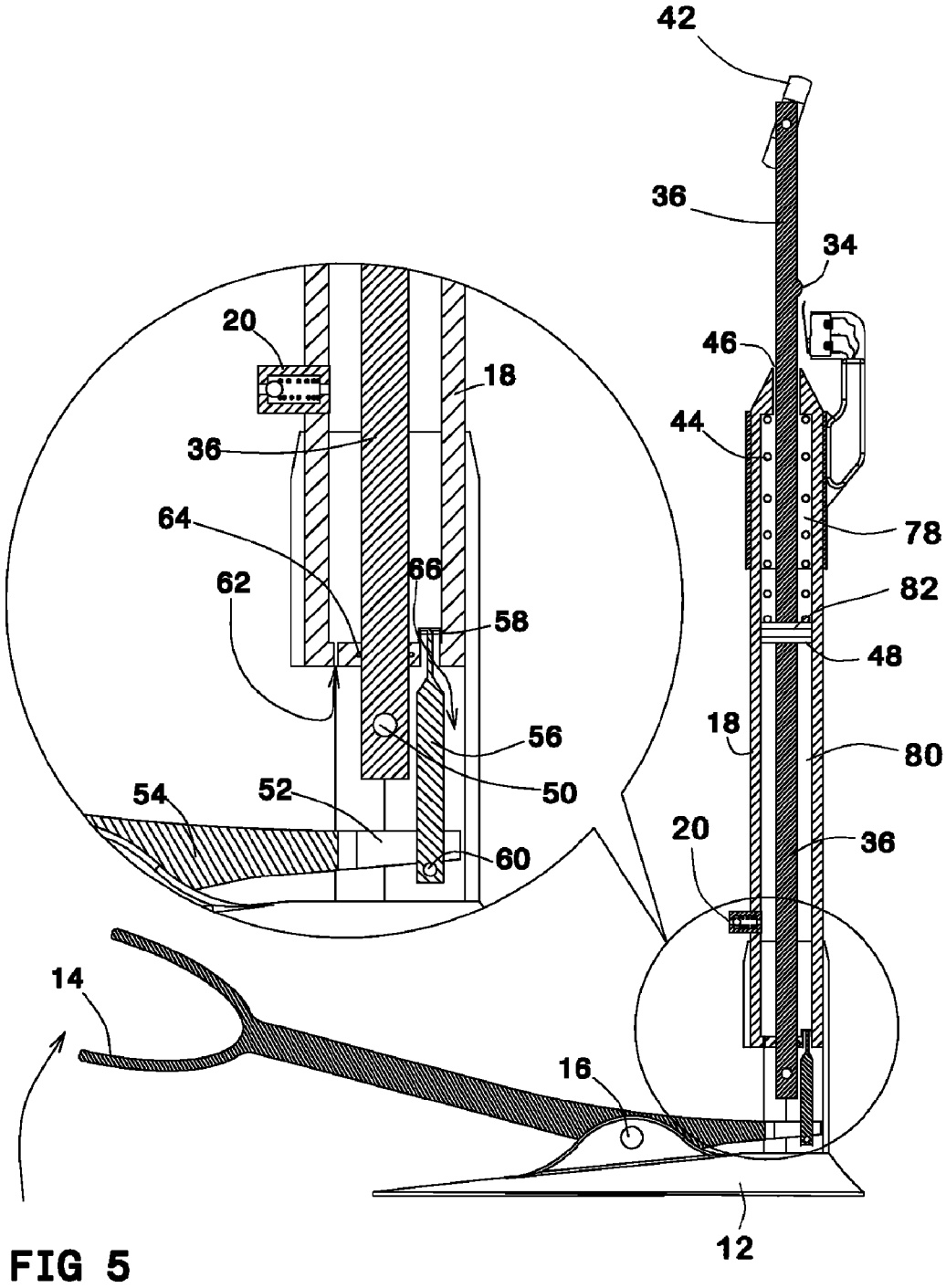
FIG. 5 is a sectional view schematically illustrating a further operation mechanism of the lifting device, according to one embodiment of the invention.

FIG. 5 is a sectional view schematically illustrating a further operation mechanism of the lifting device, according to one embodiment of the invention.

In the event the user wants to expedite the movement of the seat, e.g., for cleaning the toilet by personnel, pedal 14 has to be pushed up. This results in pushing pin 60 downwards, thereby shifting valve 56 from opening 58 of lower space 80. Thus, in this situation, the air from the lower space can exit faster than when the only exit thereof is bore 62. The result is fast lowering of the toilet seat.

According to a further embodiment of the invention, as rod 36 shifts down, jag 34, installed on rod 36, meets electric button 32 of switch 24, thereby activating an electro-mechanic module 28 (illustrated in FIG. 6) to flush tank 8.

Actually, the illustrated mechanism cannot indicate if jag 34 moves up or down. For achieving this object, a more sophisticated mechanism is required. For example, since on lifting the toilet-seat button 32 is turned to a lesser degree than when lowering the seat, a capacitor may be employed as follows: as long as button 32 is pressed, the capacitor is charged, and if the capacitor reaches to a certain level, the sensor indicates contact. Thus, if the button is not pressed for at least a certain period of time, the sensor will not indicate that the seat is lowering. This mechanism can be employed in module 22.

Figure 6:
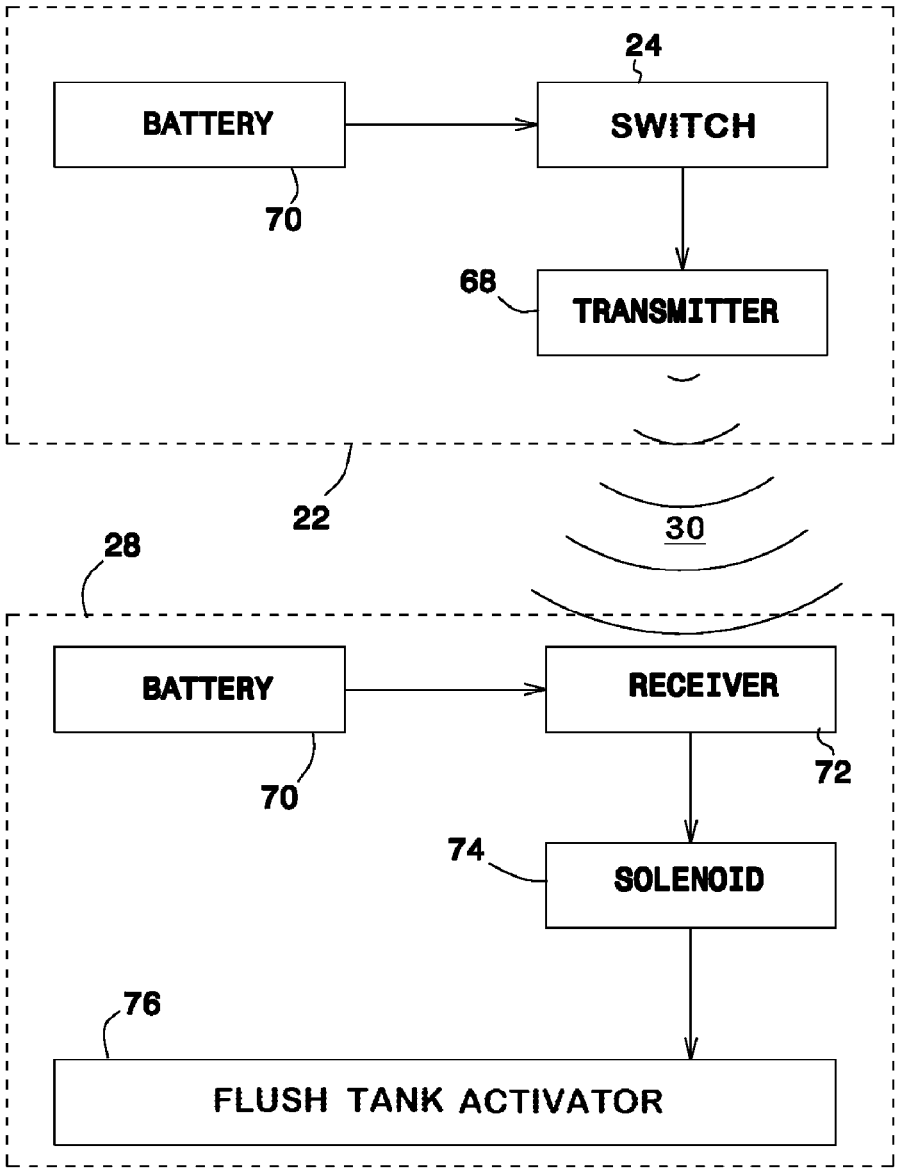
FIG. 6 is a block diagram schematically illustrating a flush activation mechanism, according to one embodiment of the invention.

FIG. 6 is a block diagram schematically illustrating a flush activation mechanism, according to one embodiment of the invention.

Module 22 comprises a sensor (which makes use of button 32 and jag 34), and a transmitter 68. Upon indicating by module 22 a signal of the switch that is associated with lowering the seat, transmitter 68 transmits a corresponding signal to module 28. Such a signal may be turning on the switch for a period of N milliseconds.

Module 28 is an electro-mechanism that activates flushing of tank 8. It comprises a receiver, corresponding to transmitter 68, and a solenoid 74 that provides the mechanical power required for operating flush tank activator 76 (e.g., a handle of a tap).

According to another embodiment of the invention, the connection between the sensing device (switch 24) and the electro-mechanic module 28 is wired.

In the figures and/or description herein, the following reference numerals have been mentioned:

numeral 2 denotes a toilet;

numeral 4 denotes the bowl of toilet 2;
numeral 6 denotes the seat of toilet 2;
numeral 8 denotes the flush tank of toilet 2;
numeral 10 denotes a lifting device of toilet seat 6, according to one embodiment of the invention;
numeral 12 denotes a base of device 10;
numeral 14 denotes a pedal of device 10;
numeral 16 denotes an hinge of lever 54;
numeral 18 denotes a cylinder;
numeral 20 denotes a one-way valve, which enables the air to enter into the lower space of cylinder 18, but not to exit;
numeral 22 denotes a transmitting module;
numeral 24 denotes an electric switch;
numeral 28 denotes a module that activates the flushing operation of toilet 2 upon receiving a corresponding signal from module 22;
numeral 30 denotes a wireless transmission;
numeral 32 denotes a button which is a part of electric switch 24;
numeral 34 denotes a jag attached to rod 36;
numeral 36 denotes a rod;
numeral 38 denotes a sleeve of cylinder 18, to which module 22 is attached;
numeral 40 denotes an hinge that lifts seat 6;
numeral 42 denotes a tab attached to seat 6 (hinge 40 is attached to this tab);
numeral 44 denotes a spring;
numeral 46 denotes a gap through which air enters and exits from the upper space 78 of cylinder 18;
numeral 48 denotes a piston;
numeral 50 denotes a pin attached to rod 36;
numeral 52 denotes a pin that lifts rod 36, and pushes down valve 56;
numeral 58 denotes an opening to the lower space of cylinder 18;
numeral 60 denotes a pin attached to valve 56;
numeral 62 denotes a bore through which air exits from the lower space of cylinder 18;
numeral 64 denotes a seal between rod 36 and cylinder 18;
numeral 66 denotes air exiting from the lower space through opening 58;
numeral 68 denotes a wireless signal transmitter;
numeral 70 denotes an electric power source, such as a battery;
numeral 72 denotes a wireless signal receiver, corresponding to transmitter 68;
numeral 74 denotes a solenoid;
numeral 76 denotes a flush tank activator;
numeral 78 denotes the upper space of cylinder 18 (i.e., the space of the cylinder above piston 48);
numeral 80 denotes the lower space of cylinder 18 (i.e., the space of the cylinder below piston 48); and
numeral 82 denotes a seal (such as rings) between piston 48 and cylinder 18.

The foregoing description and illustrations of the embodiments of the invention has been presented for the purposes of illustration. It is not intended to be exhaustive or to limit the invention to the above description in any form.

What is claimed is:

1. A device for lifting a toilet seat, said device comprising:
a pneumatic system connected to and for lifting said toilet seat;
a foot pedal activatable in two substantially opposing directions, the pedal connected to said pneumatic system, such that upon pressing said foot pedal in a first direction, air is pumped into said pneumatic system, thereby lifting said toilet seat;
said pneumatic system further comprising:
a bore, for gradually releasing the air therefrom, thereby gradually lowering the toilet seat;
an opening for releasing air from said pneumatic system in a non-gradual manner; and
a valve, for closing and opening said opening;
wherein said valve is connectable to said foot pedal such that when said foot pedal is pressed in a second direction, said valve is opened, thereby lowering said toilet seat in a non-gradual manner, and when said foot pedal is pressed in the first direction, said valve is closed.

2. A device according to claim 1, further comprising:
a sensor, for sensing lowering of said toilet seat; and
a mechanism for activating flushing upon detection by said sensor that said toilet seat is being lowered.

3. A device according to claim 2, wherein the communication of said sensor with said mechanism for activating flushing is wired.

4. A device according to claim 2, wherein the communication of said sensor with said mechanism for activating flushing is wireless.

5. A pneumatic system for raising a toilet seat comprising:
a lever, to be operated by a user's foot;
a substantially vertical rod, the lower side of said rod being connected to said lever, and the upper side of said rod being connected to an object to be lifted and lowered;
a piston, attached to said rod between the ends of said rod;
a cylinder corresponding to said piston, said rod being disposed inside said cylinder;
a bore in said cylinder in a location under said piston;
a first valve for allowing only entrance of air into said cylinder, said valve being disposed in said cylinder under said piston;
the space above said piston being unsealed, and the space below said cylinder being sealed except of said bore and said valve, said bore thereby determining the rate of air leaving the sealed space, and thereby determining the rate of automatic lowering of object.

6. A device according to claim 5, further comprising a second valve, for causing a fall in air pressure in said pneumatic system, thereby causing an accelerated lowering of said object.

* * * * *